US007159254B1

(12) United States Patent
Voorting

(10) Patent No.: US 7,159,254 B1
(45) Date of Patent: Jan. 9, 2007

(54) MOTORIZED HAMMOCK SWINGING ASSEMBLY

(76) Inventor: Aric R. Voorting, 1055 Lonnie Raker La., Crawfordville, FL (US) 32327

( * ) Notice: Subject to any disclaimer, the term of this patent is extended or adjusted under 35 U.S.C. 154(b) by 33 days.

(21) Appl. No.: 11/001,511

(22) Filed: Dec. 2, 2004

(51) Int. Cl.
*A45F 3/22* (2006.01)

(52) U.S. Cl. ..... 5/120; 5/109

(58) Field of Classification Search ..... 5/120–130, 5/108, 109, 93.1, 93.2, 95; 472/119, 107, 472/97, 96; 248/676, 156, 545
See application file for complete search history.

(56) References Cited

U.S. PATENT DOCUMENTS

| | | | | | |
|---|---|---|---|---|---|
| 100,735 | A | | 3/1870 | Delano | 5/109 |
| 225,233 | A | | 3/1880 | Mucks | 5/109 |
| 277,753 | A | | 5/1883 | Logan | 5/109 |
| 461,541 | A | * | 10/1891 | Bunker | 472/119 |
| 483,753 | A | | 10/1892 | Washburn | 5/120 |
| 597,168 | A | | 1/1898 | Millard | 5/109 |
| 600,116 | A | | 3/1898 | Benning | 5/109 |
| 657,893 | A | | 9/1900 | Lowe | 74/31 |
| 669,980 | A | | 3/1901 | Cuttern | 185/38 |
| 751,125 | A | | 2/1904 | Wertz et al. | 5/109 |
| 812,387 | A | | 2/1906 | Wertz | 5/109 |
| 860,156 | A | | 7/1907 | Scalf | 5/109 |
| 946,206 | A | | 1/1910 | Bosco | 5/109 |
| 1,003,208 | A | | 9/1911 | Schaefer | 5/120 |
| 1,227,924 | A | | 5/1917 | Odean | 49/168 |
| 1,439,619 | A | | 12/1922 | Dziedzic | 5/109 |
| 1,450,635 | A | | 4/1923 | Lacki | 5/109 |
| 1,505,117 | A | | 8/1924 | Withun | 472/119 |
| 1,524,416 | A | | 1/1925 | Waitekaites et al. | 5/109 |
| 1,603,578 | A | * | 10/1926 | Biernat | 297/12 |
| 1,702,190 | A | * | 2/1929 | Anello | 297/8 |
| 1,727,635 | A | | 10/1929 | Crane | 5/109 |
| 2,076,675 | A | | 4/1937 | Sharp | 5/609 |
| 2,520,563 | A | * | 8/1950 | Preston | 5/109 |
| 2,564,547 | A | * | 8/1951 | Schrougham | 472/119 |
| 2,631,302 | A | * | 3/1953 | Bryant | 5/109 |
| 2,718,226 | A | | 10/1955 | Kaye | 601/65 |
| 2,765,478 | A | * | 10/1956 | Pinto | 5/104 |
| 2,793,374 | A | | 5/1957 | Doud | 5/102 |
| 2,793,375 | A | | 5/1957 | Wardell, Jr. | 5/105 |
| 2,807,309 | A | * | 9/1957 | Saint et al. | 472/119 |
| 2,972,152 | A | * | 2/1961 | Vincent | 5/109 |
| 3,146,985 | A | * | 9/1964 | Grudoski | 248/370 |
| 3,261,032 | A | | 7/1966 | Reardon | 5/108 |
| 3,526,400 | A | * | 9/1970 | Carpenter et al. | 472/119 |
| 3,611,445 | A | | 10/1971 | Hillard | 5/109 |
| 3,638,248 | A | * | 2/1972 | Silverglate | 5/105 |
| 3,692,305 | A | * | 9/1972 | Allen | 472/119 |

(Continued)

*Primary Examiner*—Robert Canfield
*Assistant Examiner*—Gay Ann Spahn
(74) *Attorney, Agent, or Firm*—Peter Loffler

(57) ABSTRACT

A motorized hammock swinging assembly automatically swings a hammock back and forth. A housing has a motor operationally connected with a crankshaft assembly. A cable is attached to a crankshaft of the crankshaft assembly and to the hammock such that when the motor is operation, the crankshaft rotates causing the cable to be pulled back and forth. The reciprocating cable causes the hammock to be swayed back and forth. The housing can be frame mounted such that the frame is secured to the ground at its point of operation, or the housing can be mounted to a structure such as a tree. The motor can be run by a battery located within the housing or by a source of AC electrical power, which source can be used to charge the battery or by a solar cell.

20 Claims, 3 Drawing Sheets

U.S. PATENT DOCUMENTS

| | | | | | |
|---|---|---|---|---|---|
| 3,806,966 | A | * | 4/1974 | Thompson | 5/109 |
| 3,821,822 | A | * | 7/1974 | Borreggine | 5/109 |
| 3,842,450 | A | * | 10/1974 | Pad | 5/109 |
| 4,033,531 | A | * | 7/1977 | Levine | 248/558 |
| 4,150,820 | A | * | 4/1979 | Bochmann | 472/119 |
| 4,198,045 | A | | 4/1980 | Miller | 272/142 |
| 4,211,401 | A | * | 7/1980 | Cunard | 472/119 |
| 4,491,317 | A | * | 1/1985 | Bansal | 472/119 |
| 4,752,980 | A | * | 6/1988 | Nafte | 5/109 |
| 4,911,429 | A | * | 3/1990 | Ogbu | 472/119 |
| 4,987,624 | A | * | 1/1991 | Nafti | 5/109 |
| 5,048,135 | A | | 9/1991 | Chen | 5/109 |
| 5,139,462 | A | * | 8/1992 | Gabe | 472/119 |
| 5,376,053 | A | * | 12/1994 | Ponder et al. | 472/119 |
| 5,553,337 | A | | 9/1996 | Lin | 5/93.2 |
| D400,426 | S | * | 11/1998 | Gillin | D8/354 |
| 5,833,545 | A | * | 11/1998 | Pinch et al. | 472/119 |
| 6,361,446 | B1 | * | 3/2002 | Lawson et al. | 472/119 |
| 2001/0027135 | A1 | * | 10/2001 | Lawson et al. | 472/119 |

* cited by examiner

MOTORIZED HAMMOCK SWINGING ASSEMBLY

BACKGROUND OF THE INVENTION

1. Field of the Invention

The present invention relates to an assembly used with a suspended hammock which assembly has a motorized swinging mechanism associated for imparting on the hammock in order to swing the hammock.

2. Background of the Prior Art

Nothing beats lying in a hammock with little to do but relax and maybe read a good book. Gently swaying in the breeze with the trees blocking the direct shine of the sun, a cool drink nearby, and the gentle sounds of nature is the good life indeed. What could be a more relaxing way to spend a quiet weekend afternoon. Due to the comfort and tranquillity of modern hammocks, such devices have become increasingly popular over the years. With the advent of portable hammocks and hammock frames, hammocks are no longer limited to areas where to solid trees are located an appropriate distance apart from one another, they are found almost anywhere where tranquillity beckons.

One undertaking that many hammocks users enjoy is to gently swing the hammock back and forth with the swaying motion of the hammock adding an extra level of tranquillity to the user. To achieve the swinging motion, some users simply place one foot onto the ground and use the grounded foot to push off in order to achieve swinging. While this method does result in hammock swinging, it requires the user to exert energy, which draws away somewhat from the relaxation process and also requires the user to have one foot dangling, which is not as comfortable as lying fully within the hammock bed. Others rely on another person to swing the hammock back and forth. While this situation is ideal to the hammock user, the person swinging the hammock, who may not be available in the first place, will soon tire of the undertaking and will go off to other tasks leaving the hammock user with the need to find alternate ways to swing the hammock. Another hammock swinging method is to attach a rope to one of the support structures of the hammock such that the user pulls on the rope to achieve the back and forth motion of the hammock. However, this method also requires physical exertion by the user and also proves ineffective when using a low-rise hammock support structure.

To address this need for swinging a hammock, automated swinging devices have been proposed. However, the prior art devices tend to be relatively complex in design and construction making such devices relatively expensive to manufacture and maintain. Other prior art devices, while automatically swinging the hammock, cause the swinging to be somewhat jerky and not smooth and continuous, the result being a less than completely satisfying experience. Still other devices swing the hammock at a speed that is too fast for the desires of the user, again taking away from the hammock experience.

Accordingly, there exists a need in the art for a hammock that has automatic swinging capabilities and that overcomes the above-stated problems found in the art. Specifically such a hammock swinging system must be relatively simple in design and construction so that the device is relatively inexpensive to manufacture, purchase, and maintain. The swinging of the hammock must be smooth and steady so that the experience is highly satisfying to the hammock user. Such a system must allow for user control of the speed of the hammock in order for each user of the device to be able to set his or her own desired speed of swinging. Ideally, such a device will be relatively simple to use and operate.

SUMMARY OF THE INVENTION

The motorized hammock swinging assembly of the present invention addresses the aforementioned needs in the art. The motorized hammock swinging assembly is an automated hammock swinging system that is relatively simple in design and construction, so that the assembly is relatively inexpensive to manufacture, acquire, and maintain. The motorized hammock swinging assembly provides a swinging motion that is very smooth and fluid and not static and jerky, so that the user of the present invention has a very satisfying experience using the device. The motorized hammock swinging assembly allows the user to vary the speed of swing in order to achieve the optimal speed level for the user. The motorized hammock swinging assembly is simple to assemble, install, and operate and is portable.

The motorized hammock swinging assembly of the present invention is comprised of a housing having a motor therein, the motor being powered by a source of electrical power. A crankshaft is disposed within the housing and is operationally connected with the motor such that motor operation causes the crankshaft to rotate. A cable has a first end attached to the crankshaft and a second end secured to a hammock, such that the cable protrudes through an opening on the housing. Motor operation causes the crankshaft to rotate, which causes the cable to be reciprocated back and forth thereby imparting a swaying motion on the hammock. The speed of the motor is variable. The source of electrical power may be a battery held within the housing and/or a transformer that is plugged into a source of AC electrical power (standard AC plug) and also is electrically connected to the motor for powering the motor and to the battery for recharging the battery and/or a solar cell which may also recharge the battery. A flap covers the opening on the housing with the cable passing through the flap. A frame may be provided to hold the housing, the frame secured to the ground. The frame has an upright stanchion such that the housing is attached to the stanchion and is adjustably positionable along a length of the stanchion. The frame has at least one lawn spike attached thereto, the lawn spike being used to secure the frame to the ground. At least one strap may be provided and attached to the housing such that the strap encompasses a support structure for securing the housing to the support structure. The length of the strap is adjustable.

BRIEF DESCRIPTION OF THE DRAWINGS

Similar reference numerals refer to similar parts throughout the several views of the drawings.

DESCRIPTION OF THE PREFERRED EMBODIMENT

Figure 1:
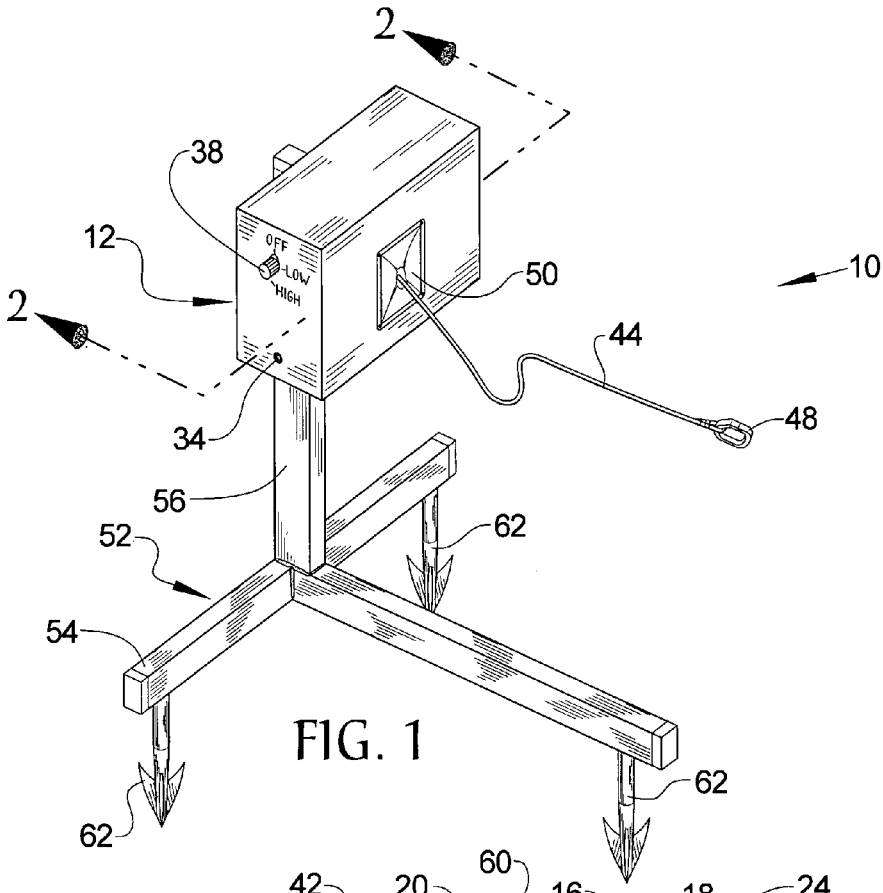
FIG. 1 is a perspective view of the motorized hammock swinging assembly of the present invention.
Figure 2:
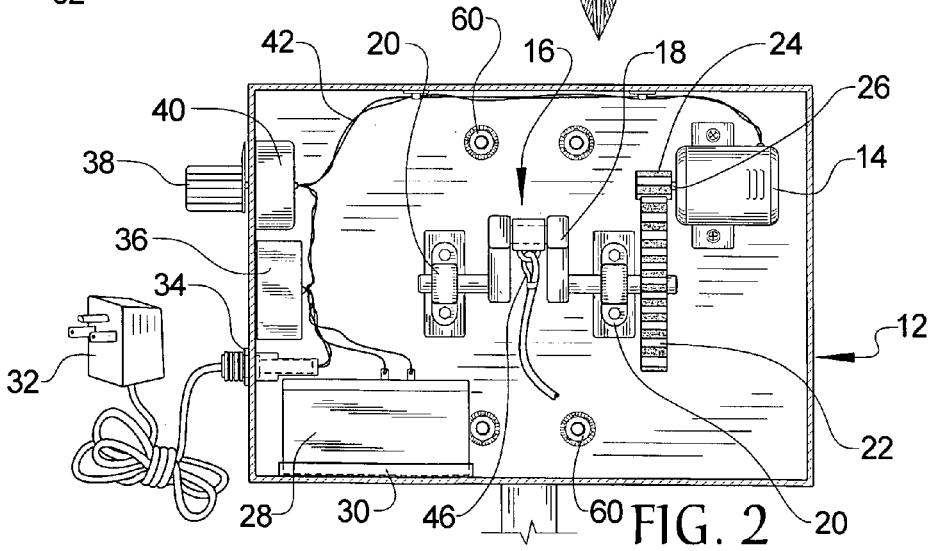
FIG. 2 is a sectional view of the motorized hammock swinging assembly taken along line 2—2 in FIG. 1.

Referring now to the drawings, it is seen that the motorized hammock swinging assembly, generally denoted by reference numeral 10, is comprised of a housing 12 having a motor 14 located therein. A crank assembly 16 is located within the housing 12 and is operatively connected with the motor 14. The crank assembly 16 includes a crankshaft 18 that has either end anchored within a crank bearing 20. A crank gear 22 is attached to one end of the crankshaft 18 and meshes with a drive gear 24 attached on the end of the drive shaft 26 of the motor 14. Whenever the motor 14 is operational, its drive shaft 26 rotates, which causes the drive gear 24 on the end of the drive shaft 26 to rotate. The rotating drive gear 24, being meshed with the crank gear 22, causes the crank gear 22 to rotate, which in turn causes the crankshaft 18 to rotate. The motor 14 is powered by either a battery 28 located on a battery tray 30 within the housing or by a source of standard household power such that a typical AC transformer 32 is plugged into an appropriate wall socket (not illustrated) and its other end plugged into a transformer jack 34 located on the housing 12, the transformer 32 reducing the voltage coming from the standard wall power outlet and turning the current from alternating current to direct current. Advantageously, a dual system is used such that both the battery 28 provides operation power to the motor 14 as does the AC transformer 32. The transformer 32 recharges the battery 28 when the motor 14 is not operational and can provide trickle down charging when the motor 14 is operational. Additionally, a solar cell may be provided to power the motor 14 and recharge the battery 28. Appropriate charging and switching circuitry 36 of conventional design is provided within the housing 12. A speed control switch 38 having appropriate and conventional circuitry 40 is provided for controlling the speed of the motor 14. The speed control switch 38 may provide a finite number of speed positions, as illustrated, or may provide variable speed control for the motor 14. Appropriate wiring 42 connects the various components of the electrical system of the device 10, including the battery 28, the jack 34, the charging and switching circuitry 36, the speed control 38, and the motor 14.

A cable 44 has one end 46 attached to the crankshaft 18 and has a quick disconnect clip 48 located on its opposite end. The cable 44 passes through an opening on the housing 12 which is protected by a weather-resistant flap 50.

Figure 3:
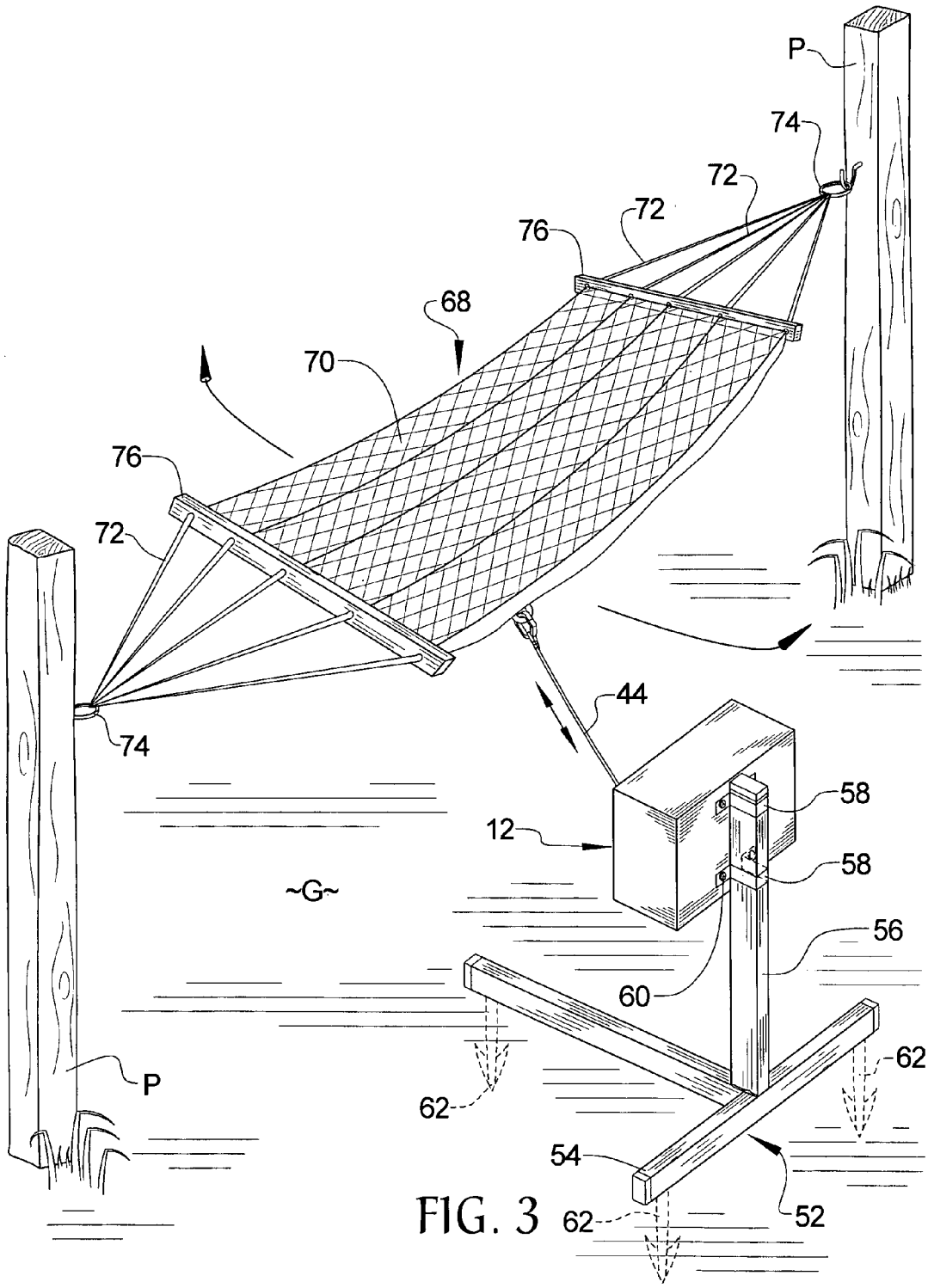
FIG. 3 is a perspective view of the motorized hammock swinging assembly wherein the assembly is frame mounted.
Figure 4:
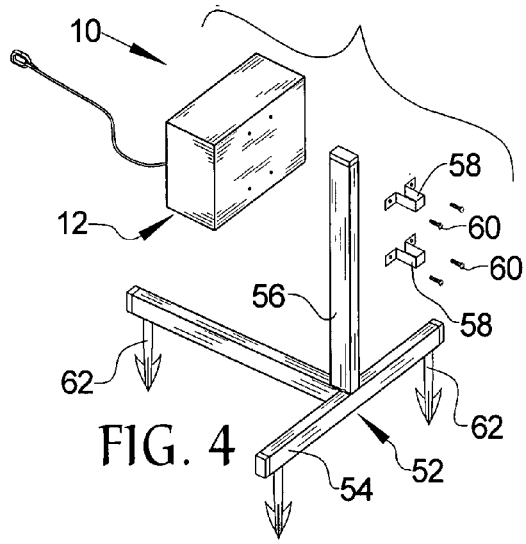
FIG. 4 is an exploded view of the frame mounted motorized hammock swinging assembly.

The housing 12 can be mounted on a frame 52, as best illustrated in FIGS. 1, 3, and 4, such that the frame 52 has a base 54 and an upright stanchion 56, such that the housing 12 is attached to the stanchion 56. A pair of attachment clips 58 encompass the stanchion 56 and are attached to the housing 12 by appropriate locknut assemblies 60. This method of attachment allows for the housing 12 to be height adjusted along a length of the stanchion 56 simply by loosening some of the locknut assemblies 60, moving the housing 12 to the desired height and thereafter retightening the locknut assemblies 60. As seen, the base 54 of the frame 52 has lawn spikes 62 thereon in order to allow the frame 52 to be secured to the ground G.

Figure 5:
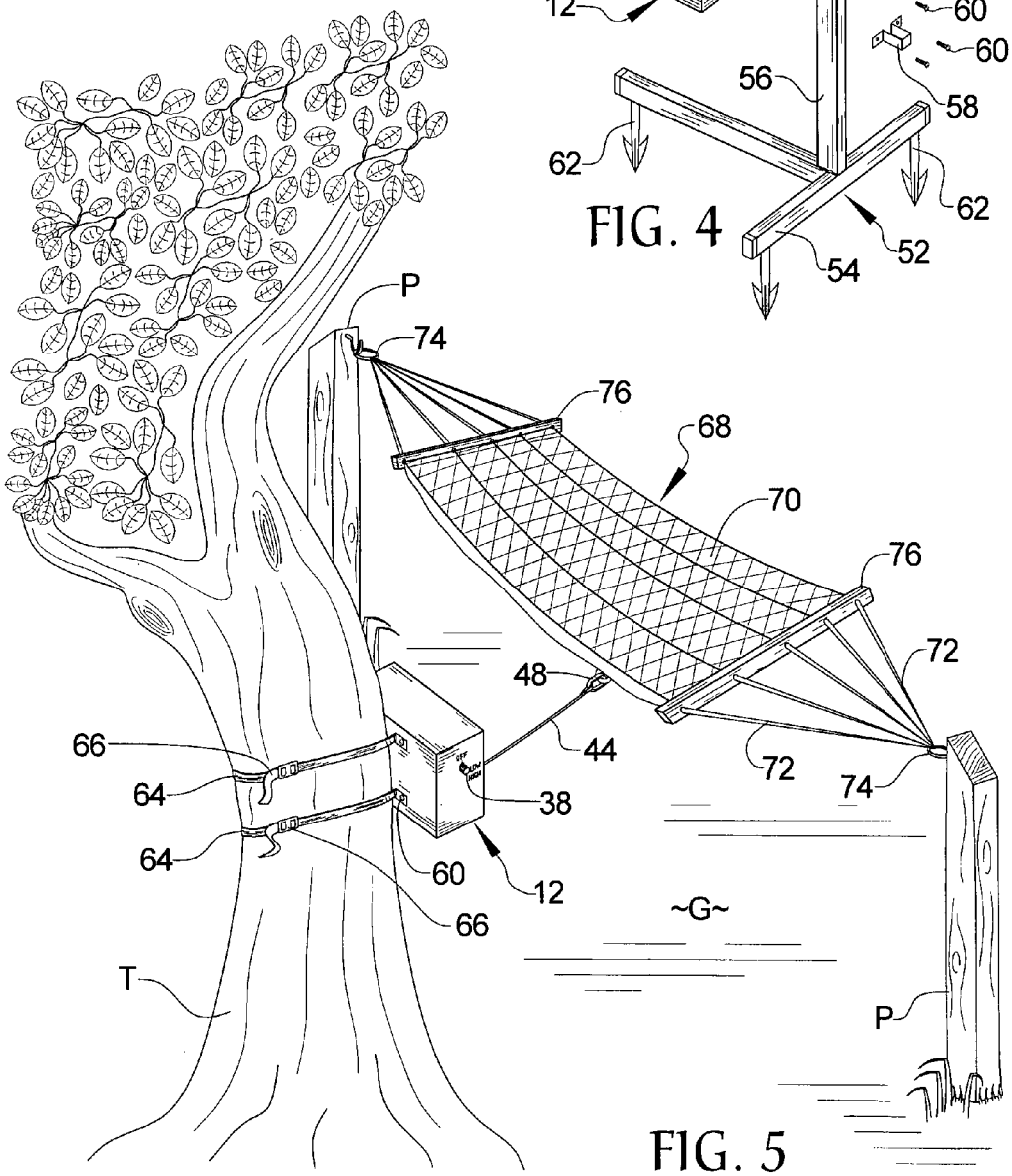
FIG. 5 is a perspective view of the motorized hammock swinging assembly wherein the assembly is tree mounted.

Alternately, the housing 12 can be secured to an existing structure, such as the tree T illustrated in FIG. 5, by providing a pair of straps 64 that encompass the structure T with the ends of the straps 64 being attached to the housing 12 by the locknut assemblies 60. Each strap 64 has an appropriate sizing means 66 thereon for adjusting the length of each strap 64 as needed.

A hammock 68 is provided, the hammock 68 being of any desired design known in the art. As seen, a typical hammock 68 has a bed 70 held by a plurality of support ropes 72 that culminate at either end of the hammock at a mount ring 74. The support ropes 72 pass through a spreader bar 76 at either end of the bed 70. The hammock 68 is mounted to an appropriate structure such as the support posts P illustrated, however, the hammock can be mounted to any desired support structure including trees, fence posts, hammock frames, etc. The housing 12 is mounted near the hammock 68, either by placing the frame 52 near the hammock 68 and securing the frame 52 to the ground G by way of the lawn spikes 62 or the housing 12 is mounted to a desired support structure T, the particular choice of how to mount the housing 12 being dependent on the location of the hammock 68 and the availability or lack thereof of support structures T for the housing 12. If the housing 12 is mounted on the frame 52, then the height of the housing 12 along the stanchion 56 is adjusted as needed. If the housing 12 is structure T mounted, then the straps 64 are tightened so as to firmly secure the housing 12 to the support structure T. The cable 44 is attached to the hammock 68 at a desired location along the hammock 68 by the quick disconnect clip 48 provided on the end of the cable 44. If desired, the transformer 32 is plugged into an outlet and also to the jack 34 in order to provide electrical power to the motor 14. If an AC outlet is not available, or if the user simply decides to run the motor 14 by the battery 28 and/or solar cell, then the transformer 32 is not used. In either case, the motor 14 is switched on by the speed control switch 38 and the speed of the motor 14 is adjusted to a desired level by the switch 38. The operational motor 14 causes the crankshaft 18 to rotate which causes the cable 44 to be pulled back and forth. The back and forth travel of the cable 44 causes the hammock 68, to which the cable 44 is attached, to be pulled back and forth causing the desired swaying motion of the hammock 68. The cable 44 passes through the flap 50 on the housing 12, which flap 50 helps prevent moisture and other debris from entering the housing 12. If the motor 14 is being run by the battery 28, and the battery runs low, then the transformer 32 can be plugged into the wall socket and to the jack 34 in order to either run the motor 14, recharge the battery 28, or both.

The motorized hammock swinging assembly 10 of the present invention is very versatile in that the hammock 68 can be mounted almost anywhere and still be connected to the assembly 10, as the assembly can be either frame 52 mounted or structure T mounted. Additionally, as the device 10 can be run on a battery 28 or solar cell, use of the device 10 is not dependent on the availability of standard household power so that a person can use the device 10 in a relatively remote location and once finished, bring device 10 to an appropriate wall socket in order to recharge the battery 28 for the next usage.

While the invention has been particularly shown and described with reference to embodiments thereof, it will be appreciated by those skilled in the art that various changes in form and detail may be made without departing from the spirit and scope of the invention.

I claim:

1. A swinging assembly comprising:

a housing;

a motor disposed within the housing;

a source of electrical power for powering the motor;

a crankshaft disposed within the housing and operationally connected with the motor such that motor operation causes crankshaft rotation;

a cable having a first end attached to the crankshaft and a second end adapted to be secured to a hammock, the cable protruding through an opening on the housing;

a flap covering the opening on the housing, the cable passing through the flap; and wherein motor operation causes the crankshaft to rotate, which causes the cable to be reciprocated back and forth imparting a swaying motion on the hammock.

2. The swinging assembly as in claim 1 wherein the source of electrical power is a battery held within the housing.

3. The swinging assembly as in claim 2 wherein the source of electrical power further comprises a transformer adapted to be plugged into a source of AC electrical power and also to be electrically connected to the motor for powering the motor and to the battery for recharging the battery.

4. The swinging assembly as in claim 1 wherein the source of electrical power comprises a transformer adapted to be plugged into a source of AC electrical power and also to be electrically connected to the motor for powering the motor.

5. The swinging assembly as in claim 1 further comprising a frame adapted to be secured to the ground, the housing attached to the frame.

6. The swinging assembly as in claim 5 wherein the frame has an upright stanchion such that the housing is attached to the stanchion and is adjustably positionable along a length of the stanchion.

7. The swinging assembly as in claim 5 where the frame has at least one spike attached thereto, the spike being used to secure the frame to the ground.

8. The swinging assembly as in claim 1 wherein the speed of the motor is variable.

9. The swinging assembly as in claim 1 further comprising at least one strap attached to the housing such that the strap is adapted to encompass a support structure for securing the housing to the support structure.

10. The swinging assembly as in claim 9 wherein the length of the strap is adjustable.

11. A swinging assembly comprising:

a housing;

a motor disposed within the housing;

a source of electrical power for powering the motor;

a crankshaft disposed within the housing and operationally connected with the motor such that motor operation causes crankshaft rotation;

a hammock;

a cable having a first end attached to the crankshaft and a second end secured to the hammock, the cable protruding through an opening on the housing;

a flap covering the opening on the housing, the cable passing through the flap; and wherein motor operation causes the crankshaft to rotate, which causes the cable to be reciprocated back and forth imparting a swaying motion on the hammock.

12. The swinging assembly as in claim 11 wherein the source of electrical power is a battery held within the housing.

13. The swinging assembly as in claim 12 wherein the source of electrical power further comprises a transformer adapted to be plugged into a source of AC electrical power and also to be electrically connected to the motor for powering the motor and to the battery for recharging the battery.

14. The swinging assembly as in claim 11 wherein the source of electrical power comprises a transformer adapted to be plugged into a source of AC electrical power and also to be electrically connected to the motor for powering the motor.

15. The swinging assembly as in claim 11 further comprising a frame adapted to be secured to the ground, the housing attached to the frame.

16. The swinging assembly as in claim 15 wherein the frame has an upright stanchion such that the housing is attached to the stanchion and is adjustably positionable along a length of the stanchion.

17. The swinging assembly as in claim 15 where the frame has at least one spike attached thereto, the spike being used to secure the frame to the ground.

18. The swinging assembly as in claim 11 wherein the speed of the motor is variable.

19. The swinging assembly as in claim 11 further comprising at least one strap attached to the housing such that the strap is adapted to encompass a support structure for securing the housing to the support structure.

20. The swinging assembly as in claim 19 wherein the length of the strap is adjustable.

* * * * *